US005385344A

United States Patent [19]

Miller et al.

[11] Patent Number: 5,385,344

[45] Date of Patent: Jan. 31, 1995

[54] MODULAR DEVICE FOR PLAYING PRANKS

[75] Inventors: Kenneth C. Miller, Mountain View; J. Courtenay Heater, Cupertino, both of Calif.

[73] Assignee: Mr. Fun Guy, Inc., Mountain View, Calif.

[21] Appl. No.: 980,763

[22] Filed: Nov. 24, 1992

[51] Int. Cl.[6] ..... A63H 5/00

[52] U.S. Cl. ..... 273/460; 446/406; 446/310; 472/51; 472/53; 472/55; 472/56

[58] Field of Search ..... 273/460; 446/297, 302, 446/310, 397, 405, 406, 408; 472/51-57, 137

[56] References Cited

U.S. PATENT DOCUMENTS

| | | | |
|---|---|---|---|
| 3,119,201 | 1/1964 | Brown et al. | 472/51 X |
| 3,885,576 | 5/1975 | Symmes | 472/56 X |
| 4,229,903 | 10/1980 | Morrison et al. | 446/190 |
| 4,582,317 | 4/1986 | Provenzano, Jr. | 472/70 |
| 4,712,246 | 12/1987 | Morrison | 446/302 |
| 4,757,491 | 7/1988 | Koike | 369/63 |
| 4,786,048 | 11/1988 | Lahti et al. | 472/51 X |
| 4,811,506 | 3/1989 | Mehta | 40/427 |
| 4,840,602 | 6/1989 | Rose | 446/175 |
| 4,904,222 | 2/1990 | Gastgeb et al. | 446/405 |
| 4,973,285 | 11/1990 | Diotte | 446/142 |

*Primary Examiner*—Vincent Millin
*Assistant Examiner*—Kerry Owens
*Attorney, Agent, or Firm*—Limbach & Limbach

[57] ABSTRACT

A system of remotely actuated novelty devices is disclosed having triggering and actuating components packaged in separate, interchangeable modules. The system includes several interchangeable trigger modules, each of which detects the occurrence of an activating event and in response generates a trigger signal of finite duration, and several interchangeable action modules, each of which performs a prank in response to a trigger signal. Each action module includes a battery that powers the action module and any trigger module connected to it.

16 Claims, 19 Drawing Sheets

MODULAR DEVICE FOR PLAYING PRANKS

BACKGROUND OF THE INVENTION

1. Field of the Invention

This invention relates generally to devices for playing pranks, and relates more particularly to remotely actuated devices having triggering and actuating components that are packaged in separate, interchangeable modules.

2. Description of the Relevant Art

In the past, devices for playing pranks were generally activated by a single mechanical means. For example, a trip wire would activate a noise maker, or a bucket of water balanced on top of a door would fall when the door is opened. These mechanical means for activating the prank were limited in that once the trip wire or other means is discovered, the prank could be defeated by the intended victim.

SUMMARY OF THE INVENTION

In accordance with the illustrated preferred embodiment, the present invention is a system of remotely actuated novelty devices having triggering and actuating components that are packaged in separate, interchangeable modules. The system includes several interchangeable trigger modules, each of which detects the occurrence of an activating event and in response generates a trigger signal of finite duration, and several interchangeable action modules, each of which performs a prank in response to a trigger signal. Each action module includes a battery that powers the action module and any trigger module connected to it. A cable connects a selected trigger module to a selected action module to supply electrical power to the trigger module and to supply the trigger signal to the action module.

The trigger modules of the present invention have electronic circuits that sense an activating or triggering event and, in response, generate a trigger signal. Trigger modules can be triggered by audible or inaudible sound, by visible or infrared light, by the proximate position of an object, by touch or trip wire, by elapsed time, or by other physical phenomena that can be sensed. The activating events can be initiated by the deliberate action of the perpetrator of a prank, or unwittingly by the victim of the joke, depending on the type of trigger module selected.

The action modules of the present invention include electronic circuits and mechanical apparatus that perform a prank of some sort upon receipt of a trigger signal from a trigger module. Three major types of action modules are sound-generators, motor-drivers, and solenoid-drivers. A sound-generator action module generates a pre-stored sound like a whistle, boom, explosion, laugh, scream, or expletive. A motor-driver action module drives a motor that causes an action like squirting water, rotating strobe lights, firing a cap gun, or dangling a fake spider. A solenoid-driver action module energizes a solenoid that causes an action like releasing balloons, firing a catapult, opening a jack-in-the-box, launching an airplane, or opening a trap door to drop confetti or creepy things from a box.

The trigger and action modules can be daisy-chained together so that one trigger causes several actions. For example, an infrared trigger module can be daisy-chained to a sound-generator action module with an explosion sound stored therein, a motor-driver action module that fires a flash bulb, and a solenoid-driver action module that releases a smoke bomb. When the victim uses a remote control transmitter to turn on his television, the trigger module senses it and triggers the explosion, flash, and smoke, and the victim thinks that his television has just exploded.

A time delay between the activating event and the action can be accomplished with a timer module according to the present invention. A timer module having a preselected time delay is connected between a trigger module and an action module. When an activating event is detected, the trigger module activates the timer module, which in turn activates the action module after the timer times out.

A key advantage of the present invention is that any trigger module can be coupled to any action module. This allows a prank to be played in several ways, thus overcoming the boredom factor in prior art amusement devices and providing more flexibility in using the components.

The features and advantages described in the specification are not all inclusive, and particularly, many additional features and advantages will be apparent to one of ordinary skill in the art in view of the drawings, specification and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

BRIEF DESCRIPTION OF THE DRAWINGS

FIG. 21*b* is a side view of the catapult, while

DETAILED DESCRIPTION OF THE PREFERRED EMBODIMENT

FIGS. 1 through 22 of the drawings depict various preferred embodiments of the present invention for purposes of illustration only. One skilled in the art will readily recognize from the following discussion that alternative embodiments of the structures and methods illustrated herein may be employed without departing from the principles of the invention described herein.

Figure 1:
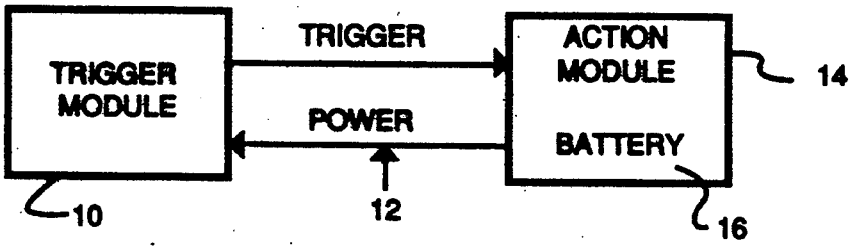
FIG. 1 is a simplified block diagram of a modular device for playing pranks according to the present invention.

The preferred embodiment of the present invention is a system of remotely actuated novelty or amusement devices for playing pranks. The devices have triggering and actuating components that are packaged in separate, interchangeable modular devices. As shown in FIG. 1, a trigger module 10 is connected by a cable 12 to an action module 14 that includes a battery 16. The trigger module 10 detects the occurrence of an activating event of some sort and, in response, generates a trigger signal of finite duration. The cable 12 supplies the trigger signal to the action module 14, which responds to the trigger signal to perform a prank or amusement action of some sort. The cable 12 also supplies power from the action module 14 to the trigger module 10. Preferably, the cable 12 is a four conductor wire (24 gauge), of the type commonly used for telephone wiring, with RJ11-type connectors on each end of the cable.

Figure 2:
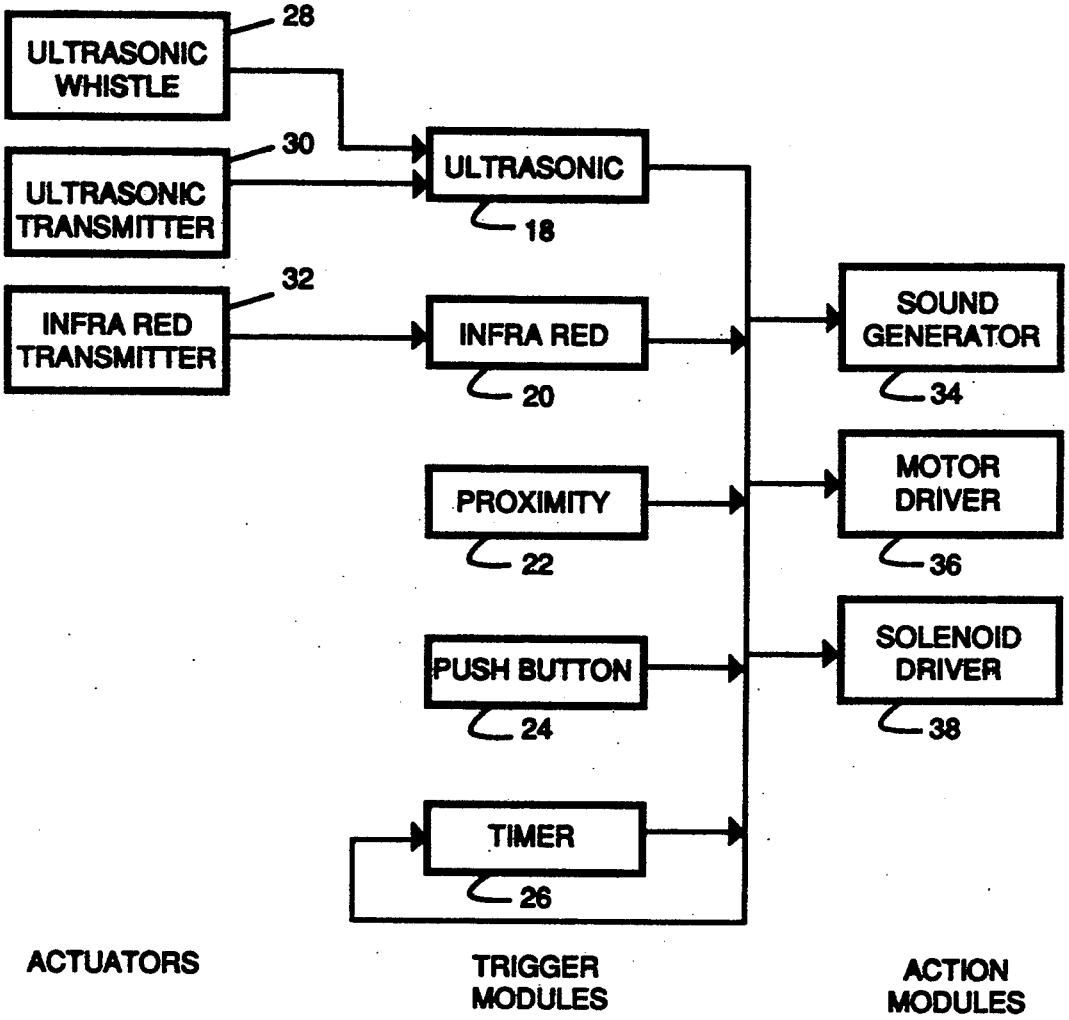
FIG. 2 is a block diagram of exemplary actuators, trigger modules, and action modules of the present invention.

FIG. 2 illustrates some of the trigger modules 10 and action modules 14 that comprise the modular novelty device system of the present invention. Five types of trigger modules 10 are illustrated: an ultrasonic trigger module 18, an infrared trigger module 20, a proximity trigger module 22, a push button trigger module 24, and a timer trigger module 26. The ultrasonic trigger module 18 can be triggered by either an ultrasonic whistle actuator 28 or an ultrasonic transmitter actuator 30. For construction details of an ultrasonic whistle actuator 28 or an ultrasonic transmitter actuator 30 see FIGS. 5–8 and corresponding text of U.S. patent application Ser. No. 07/823,864, filed Jan. 22, 1992, the disclosure of which is hereby incorporated by reference. The infrared trigger module 20 can be triggered by an infrared transmitter actuator 32 such as remote control transmitters commonly used to control consumer electronic equipment like televisions and stereos. The proximity trigger module 22 is activated by detection of an object into close proximity of the module. The push button trigger module 24 is simply activated by pushing a button or closing a switch. The timer trigger module 26 can be activated by setting it manually, or by a trigger signal generated by another trigger module.

All of these trigger modules shown in FIG. 2 sense the occurrence of an activating event and generate a trigger signal of limited duration in response. Any one of the trigger modules 10 can be coupled to an action module 14. In FIG. 2, three types of action modules are shown: a sound-generator action module 34, a motor-driver action module 36, and a solenoid-driver action module 38. The action modules respond to a received trigger signal by performing the action built into the action module, such as generating a sound or driving a motor or a solenoid that initiates the prank.

Figure 3:
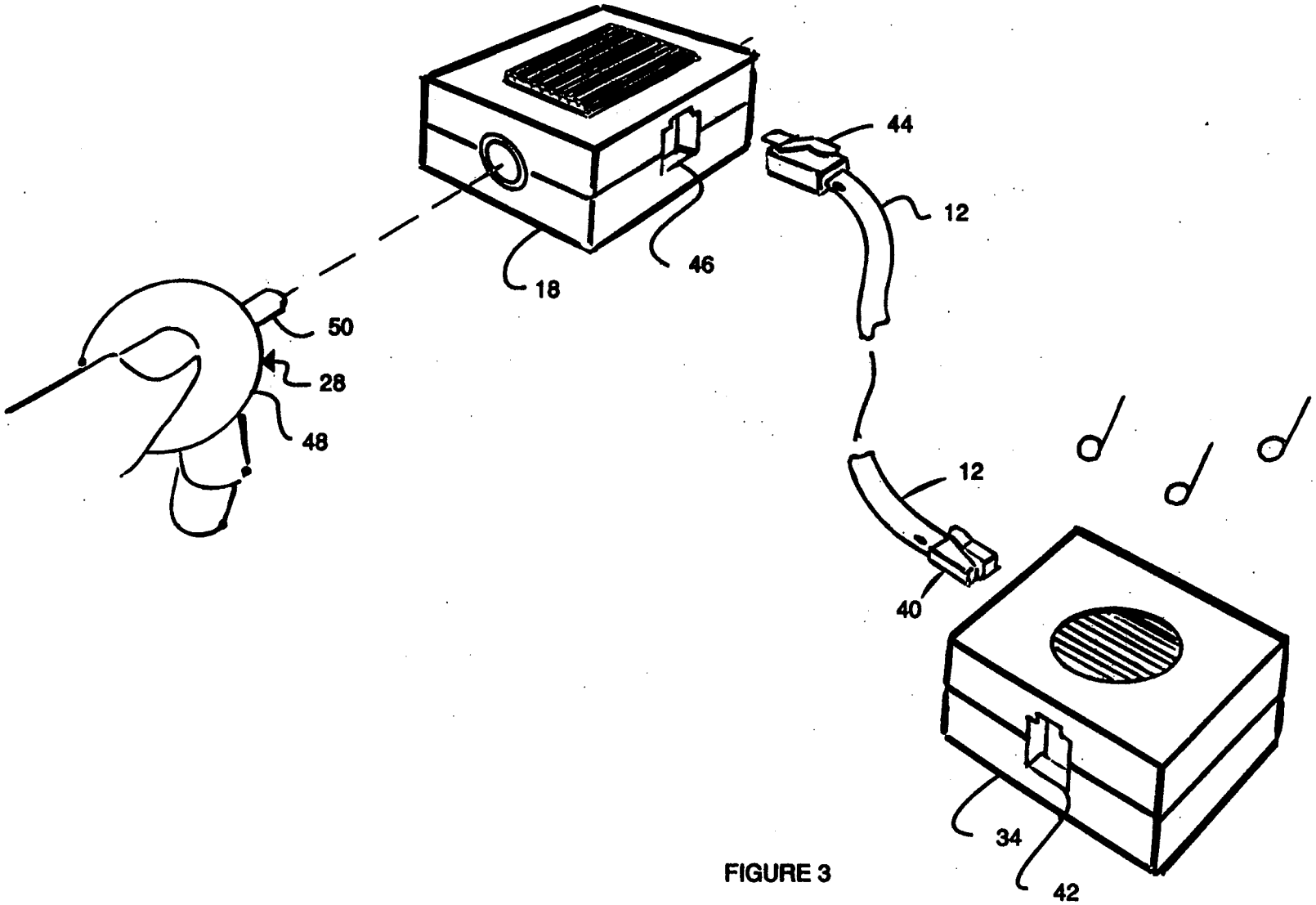
FIG. 3 is a perspective view of a sound-generating action module connected to an ultrasonic trigger module, which is activated by an ultrasonic whistle.

FIG. 3 illustrates how a remotely-actuated amusement device can be assembled from the component parts of the present invention. A sound-generator action module 34 is connected to one end of a cable 12 by inserting a plug 40 on the end of the cable into a jack 42 in the action module. A plug 44 on the other end of the cable 12 is plugged into a corresponding jack 46 in an ultrasonic trigger module 18. To activate this device, an ultrasonic whistle 28 is used. The whistle 28 includes a squeeze bulb 48 that forces air through an appropriately configured orifice 50 to cause vibrations in the ultrasonic range. (See U.S. patent application Ser. No. 07/823,864, incorporated herein by reference, for further details of the construction of the ultrasonic whistle 28). The ultrasonic trigger module 18 includes a sensor that detects the vibrations of the whistle 28 and in response generates a trigger signal. The cable 12 sends the trigger signal to the sound-generator action module 34, which, in response, generates a predetermined sound (or sequence of sounds) like a whistle, boom, explosion, laugh, scream, or expletive.

Figure 4:
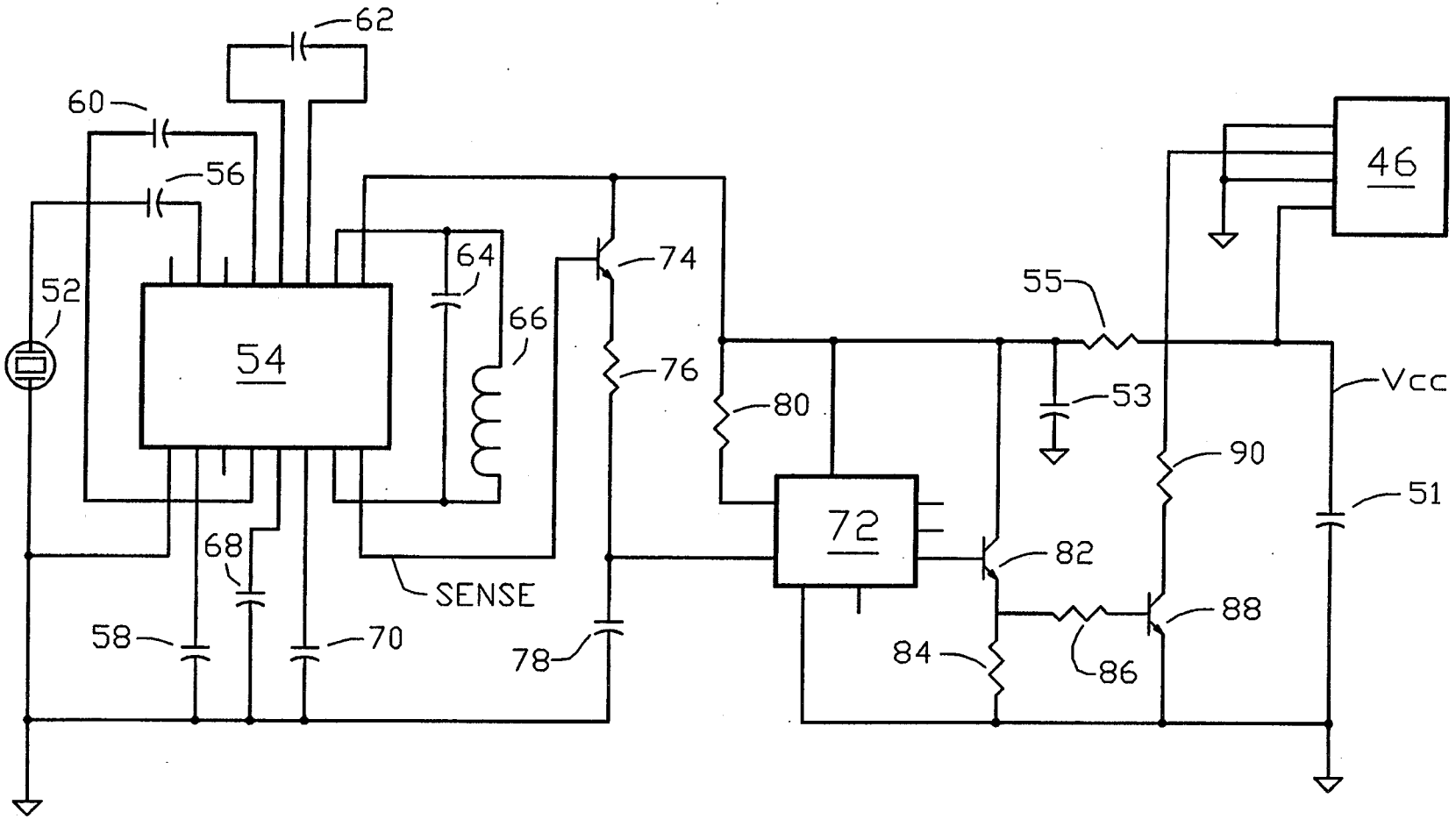
FIG. 4 is a schematic diagram of an ultrasonic trigger module circuit.

FIG. 4 illustrates the circuitry of the ultrasonic trigger module 18. The circuitry for this and other trigger modules can be grouped into four functional areas, a sensor for detecting the activating event, a timer initiated by the sensor/detector for generating a trigger signal of finite duration, an amplifier or transistor to supply the trigger signal to the cable, and an RJ11-type connector 46 for coupling the trigger module to an action module through the cable 12. When connected to an action module through a cable 12, pin 4 of connector 46 supplies power, Vcc, to the ultrasonic trigger module circuit, while pins 1 and 3 of the connector provide ground. Pin 2 of the connector 46 is pulled to ground potential by the ultrasonic trigger circuit to send the trigger signal to an attached action module. Capacitors 51 and 53, which are coupled between Vcc and ground, and resistor 55 filter the supplied Vcc.

In the ultrasonic trigger circuit of FIG. 4, an ultrasonic transducer 52 and a high frequency preamplifier chip 54 and associated components provide the sensor that senses whether ultrasonic sound is present. Preferably, the preamplifier chip 54 is a TDA 3047 three-stage amplifier available from Phillips or Signetics. The ultrasonic transducer 52 is coupled to chip input pins 2 and 15 through capacitors 56 and 58, respectively. Pins 2 and 15 are coupled to a first amplifier stage of the preamplifier chip 54. Capacitor 60, connected between pins 4 and 13, and capacitor 62, connected between pins 5 and 6, provide interstage coupling. Capacitor 64 and inductor 66 are coupled in parallel between pins 7 and 10 of the preamplifier chip 54 and comprise a tuned circuit that sets the center frequency of the preamplifier chip, preferably at about 26 KHz. Capacitors 68 and 70 are coupled between pins 11 and 12, respectively, and ground. The chip 54 generates a logic high SENSE signal at pin 9 when it detects sufficient oscillations of the ultrasonic transducer 52 at or near the center frequency.

The SENSE signal generated by the sense circuit of FIG. 4 is input to a trigger input of a timer chip 72 through an NPN transistor 74 driven by the SENSE signal. The emitter of transistor 74 is coupled through resistor 76 to a trigger input of the timer chip 72. Capacitor 78 is coupled between the trigger input and ground to provide filtering of the supplied signal. The timer chip 72 is preferably a model MSS0151 or MSS0283 speech synthesizer (voice ROM) from Mosel Corporation, and the trigger input is pin 4 thereof. Pin 3 of the timer chip 72 is coupled to Vcc through a resistor 80. As configured, the timer chip 72 outputs a current on pin 5 thereof for about 2.8 seconds upon the receipt of a logic high SENSE signal from the sensing circuit. In other applications, such as the sound generator action module 34, the output current of the timer chip 72 represents sounds stored in the voice ROM. As it is used in this and other trigger circuits, however, the timer chip 72 functions only as a timer to define the duration of the trigger signal.

The output of the timer chip 72 drives an amplifier stage that generates the trigger signal by pulling pin 2 of connector 46 to ground. Pin 5 of the timer chip 72 is connected to the base of an NPN transistor 82, while the collector of the transistor is connected to Vcc and the emitter is coupled through a resistor 84 to ground and resistor 86 to the base of another NPN transistor 88. The emitter of transistor 88 is grounded, while the collector is coupled through resistor 90 to pin 2 of the RJ11 connector 46.

When the timer chip 72 outputs a current in response to the sensing circuit detecting an ultrasonic signal, transistor 82 turns on, which turns on transistor 88 and grounds pin 2 of connector 46. The grounding of pin 2 of the connector 46 is detected by the associated action module 14 as the trigger signal. Pin 2 of the connector 46 carries the trigger signal back to an attached action module. When the trigger signal is active, transistor 88 turns on and pulls pin 2 down to ground potential. When the trigger signal is not active, transistor 88 is off and pin 2 is isolated from ground, in which case a pull-up resistor in the action module pulls the voltage on pin 2 up to Vcc.

Preferred specifications for the components of the ultrasonic trigger circuit illustrated in FIG. 4 are as follows:

| | |
|---|---|
| capacitor 51 | 100 uf |
| resistor 55 | 33 ohm |
| capacitor 58 | 0.1 uf |
| capacitor 62 | 0.01 uf |
| inductor 66 | 8.2 mh |
| capacitor 70 | 0.01 uf |
| resistor 76 | 10K ohm |
| resistor 80 | 1M ohm |
| resistor 84 | 1K ohm |
| transistor 88 | 2N3904 |
| capacitor 53 | 22 uf |
| capacitor 56 | 0.01 uf |
| capacitor 60 | 0.0047 uf |
| capacitor 64 | 0.0033 uf |
| capacitor 68 | 0.0047 uf |
| transistor 74 | 2N3904 |
| capacitor 78 | 2.2 uf |
| transistor 82 | 2N3904 |
| resistor 86 | 1K ohm |

-continued

| | |
|---|---|
| resistor 90 | 240 ohm |

Figure 5:
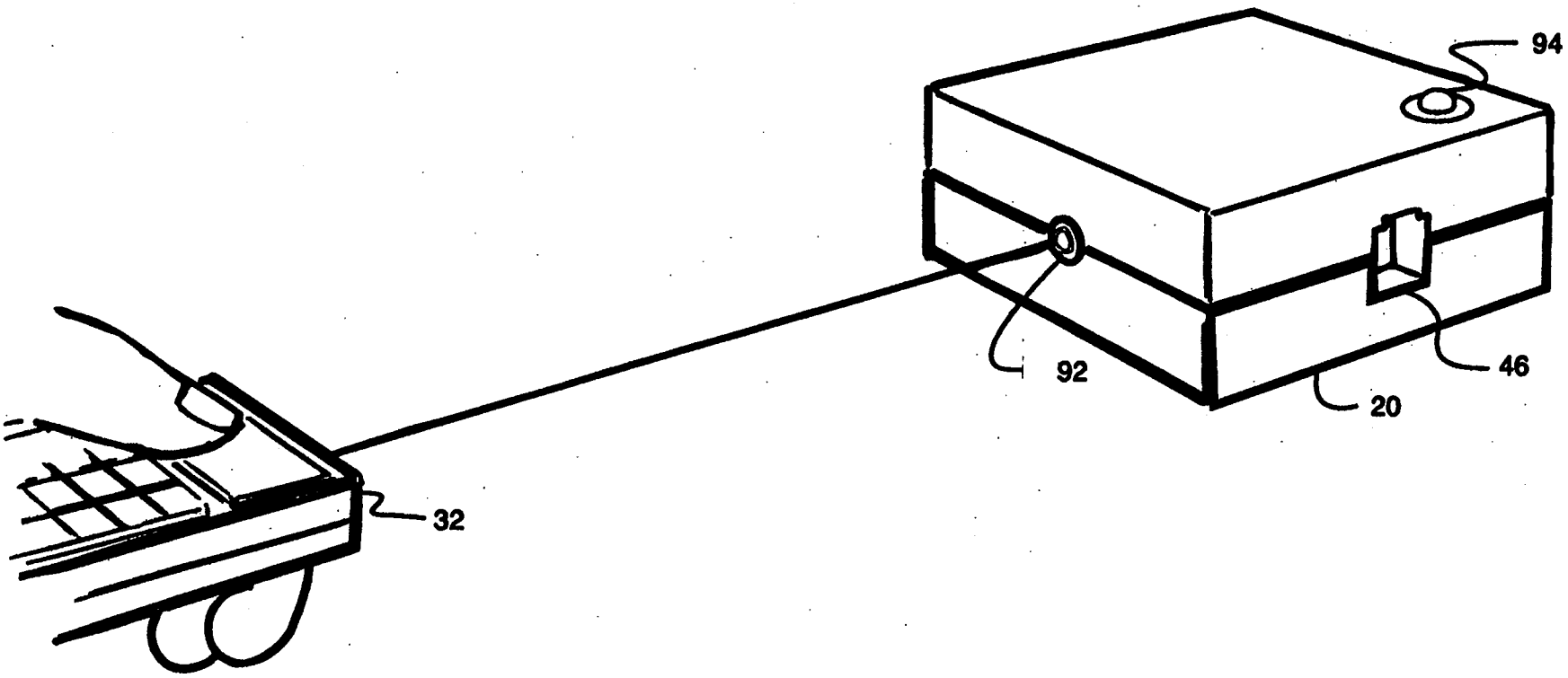
FIG. 5 is a perspective view of an infrared trigger module being activated by an infrared transmitter.

FIG. 5 illustrates the infrared trigger module 20 and its associated infrared transmitter 32. The trigger module 20 has an RJ11-type connector 46 that receives the plug end of the cable 12 (not shown) for connection to an action module. Window 92 provides an unobstructed path to a sensing diode packaged inside of the trigger module 20. An indicator LED is visible through window 94 in the housing.

Figure 6:
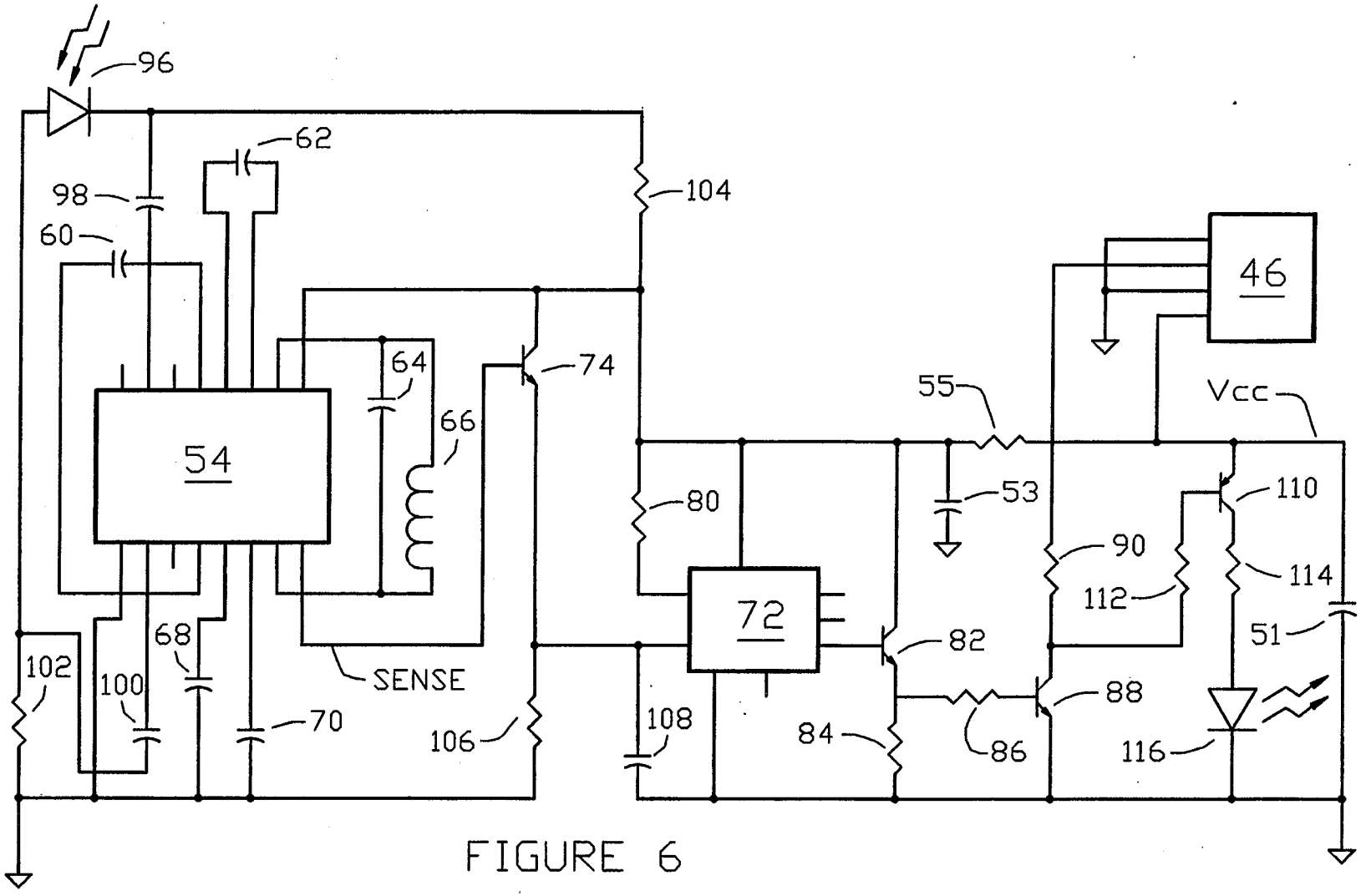
FIG. 6 is a schematic diagram of an infrared trigger module circuit.

FIG. 6 shows the circuitry of the infrared trigger module 20. This circuit is similar to that of FIG. 4, the major difference being that a different sensor is used. Here, an infrared sensing diode 96 is coupled to the inputs of the preamplifier chip 54 at pins 2 and 15 through coupling capacitors 98 and 100, respectively. The anode of infrared sensing diode 96 is also coupled to ground through resistor 102, while the cathode of the diode is coupled to Vcc through resistor 104. The other biasing and coupling components of the preamplifier chip 54 are the same as discussed above for the ultrasonic trigger circuit of FIG. 4. The sensing diode 96 is positioned behind a window 92 in the housing of the infrared trigger module 20.

The preamplifier chip 54 outputs a logic high signal on the SENSE output when the infrared diode 96 senses an activating signal of sufficient magnitude, causing NPN transistor 74 to trigger the timer chip 72. A different filter than that of the ultrasonic trigger circuit is used on the output of transistor 74 because there is less chance of false triggering with infrared frequencies. The filter includes resistor 106 and capacitor 108 coupled in parallel between the emitter of transistor 74 and ground.

The timer chip 72 turns on transistors 82 and 88 for a predetermined period of time, about 2.8 seconds, which pulls pin 2 of connector 46 to ground to send the trigger signal to the attached action module 14. The collector of transistor 88 is also coupled to the base of PNP transistor 110 through resistor 112. The emitter of transistor 110 is connected to Vcc, while the collector is coupled through resistor 114 and an LED 116 to ground. When the transistor 88 is on, it turns on transistor 110, which illuminates the LED 116 as an indicator. The LED 116 is visible through window 94 in the housing (FIG. 5).

Preferred specifications for the components of the infrared trigger circuit illustrated in FIG. 6 are as follows. Other components are the same as described above.

| | |
|---|---|
| diode 96 | BPW50 |
| capacitor 100 | 0.1 uf |
| resistor 104 | 12K ohm |
| capacitor 108 | 0.1 uf |
| resistor 112 | 1K ohm |
| capacitor 98 | 0.01 uf |
| resistor 102 | 12K ohm |
| resistor 106 | 10K ohm |
| transistor 110 | 2N3906 |
| resistor 114 | 240 ohm |

Figure 7:
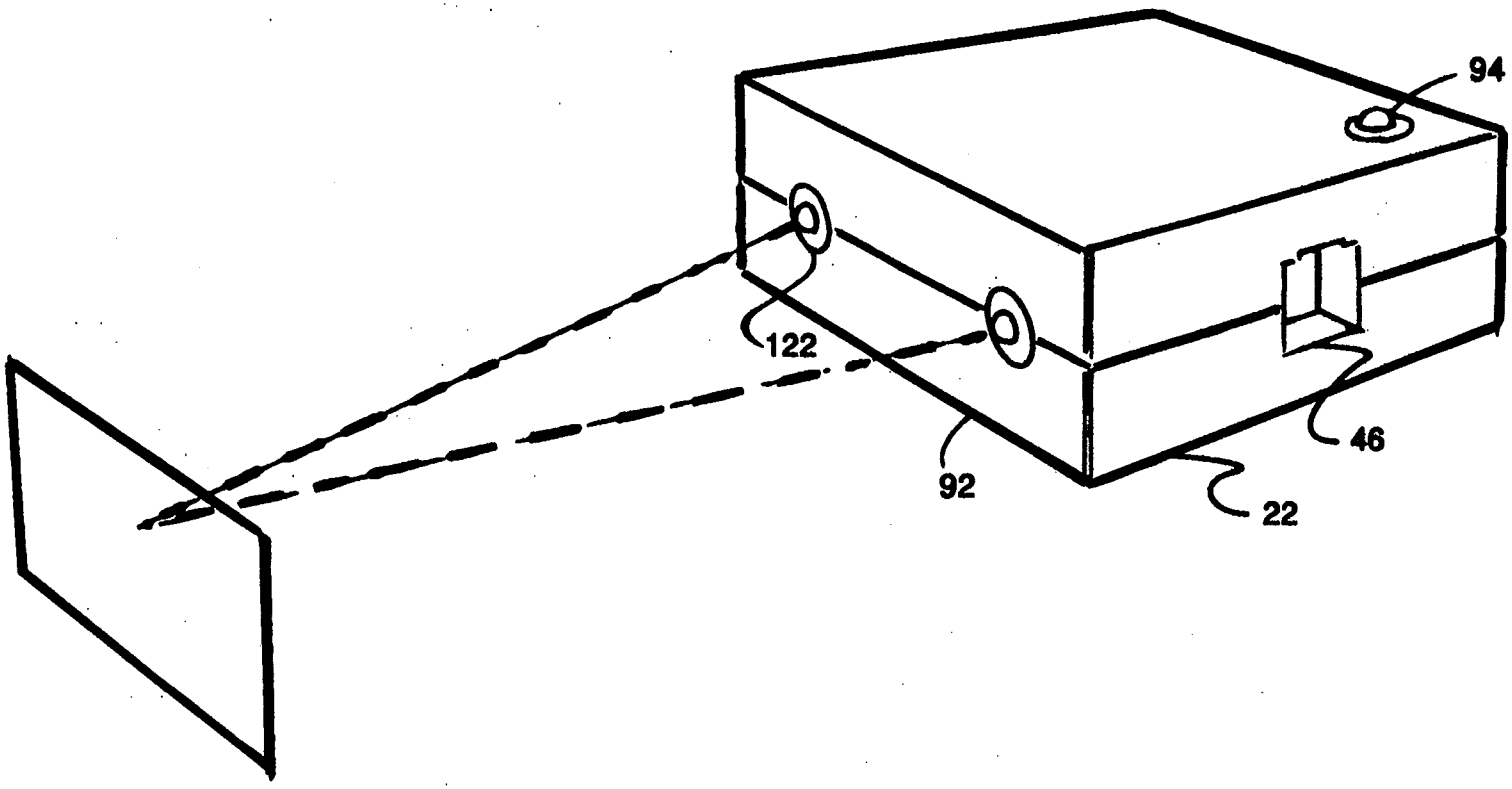
FIG. 7 is a perspective view of a proximity trigger module.
Figure 8:
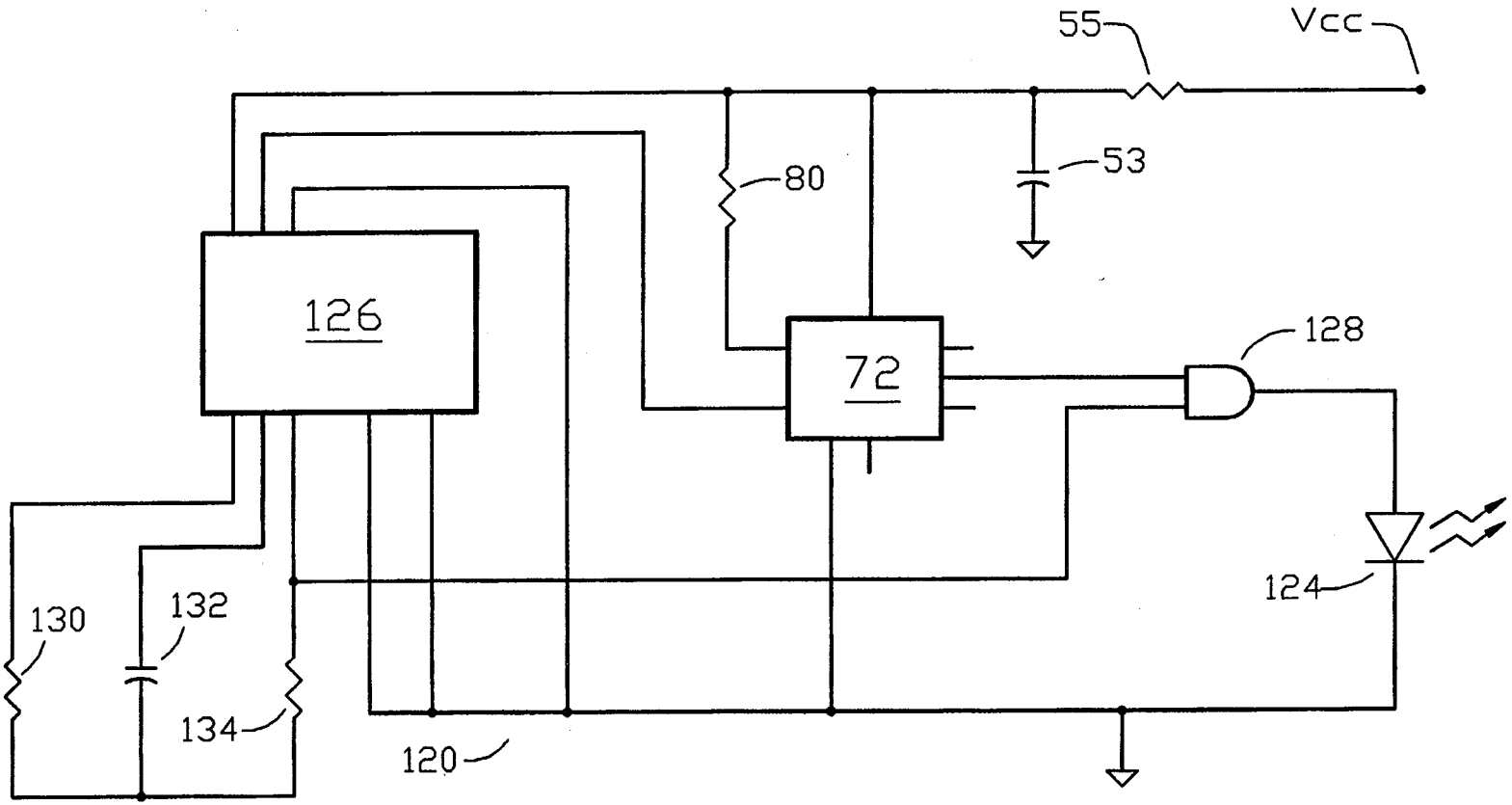
FIG. 8 is a schematic diagram of an infrared transmitter circuit for use in a proximity trigger module.

FIGS. 6, 7, and 8 illustrate the proximity trigger module 22, which includes an infrared detector circuit (FIG. 6) and an infrared transmitter circuit (FIG. 8) both packaged in the same module 22 (FIG. 7). The infrared transmitter circuit 120 (FIG. 8) generates an infrared beam and transmits it though a window 122 in the housing of the proximity trigger module. When an object (such as a person) comes close to the proximity trigger module 22, some of the transmitted infrared energy is reflected back through window 92 and detected by the detector circuit, which causes the trigger signal to be generated as described above.

The infrared transmitting circuit 120, shown in FIG. 8, includes an infrared diode 124 that is driven by a gated oscillator. The oscillator clock is provided by a Motorola MC14541 oscillator/timer chip 126 and is applied to one input of an AND gate 128. The frequency of the clock is set by resistor 130, capacitor 132, and resistor 134 coupled to input pins 1, 2, and 3, respectively, of the oscillator chip 126. Pin 3 of the oscillator chip 126 supplies the clock to the AND gate 128. The oscillator chip 126 operates in free running mode, and it outputs at pin 8 a square wave to the trigger input of timer chip 72, as described above. The timer chip 72 triggers on each rising edge of the output of the oscillator chip 126. An output of the timer chip 72 is input to the AND gate 128 to gate the clock signal to the infrared transmitter diode 124. Vcc is applied to the infrared transmitting circuit 120, but it must be isolated from the Vcc of the detector circuit to avoid false triggering through the power circuit.

Preferred specifications for the components of the infrared transmitting circuit 120 illustrated in FIG. 8 are as follows. Other components are the same as described above.

| | |
|---|---|
| diode 124 | |
| capacitor 132 | 0.01 uf |
| resistor 130 | 200K ohm |
| resistor 134 | 400K ohm |

Figure 9:
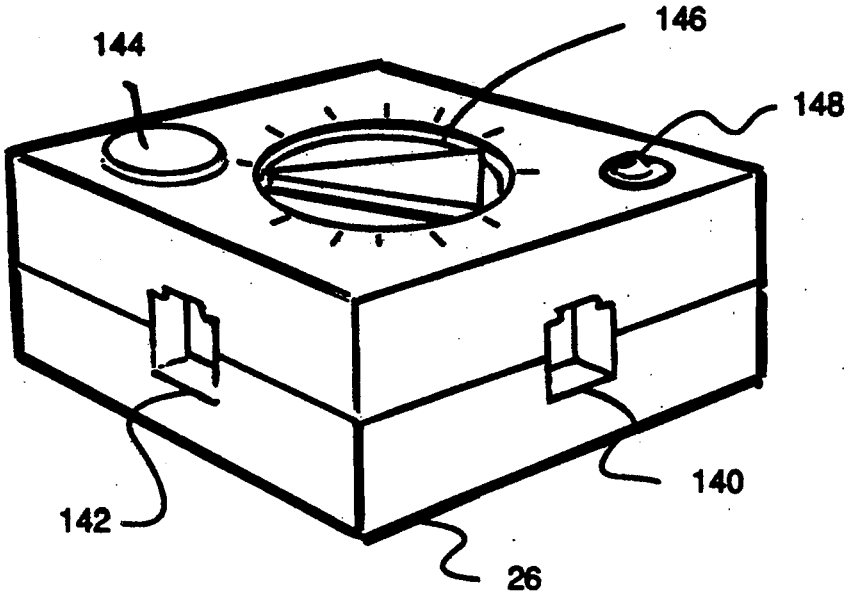
FIG. 9 is a perspective view of a timer module.
Figure 10:
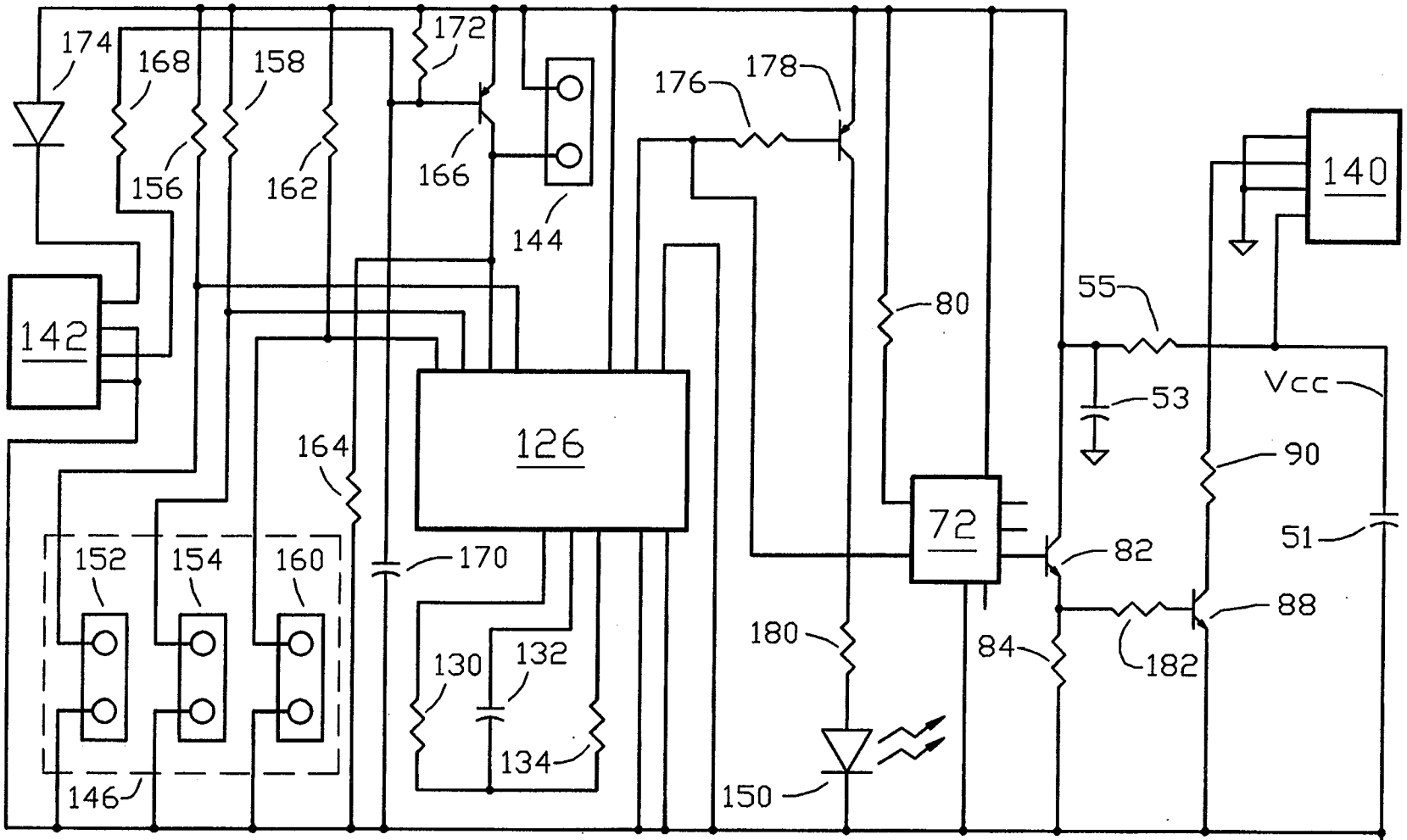
FIG. 10 is a schematic diagram of a timer module circuit.

FIGS. 9 and 10 illustrate a timer trigger module 26 of the present invention. The timer trigger module 26 has two RJ11-type connectors 140 and 142, with output connector 140 for connection to an action module 14 and input connector 142 for connection to another trigger module 10. The timer trigger module 26 can be triggered either by another trigger module attached to input connector 142, or by pushing push button 144. The timer trigger module also has a timer value selector 146 and a window 148 through which an LED 150 shines when the timer is "armed" and counting down before outputting the trigger signal.

The circuitry of the timer trigger module 26, shown in FIG. 10, includes an oscillator/timer chip 126 triggered by either the push button 144 or pin 3 of input connector 142. The oscillator/timer chip 126 is preferably a Motorola MC14541 chip, with its oscillator frequency set by resistor 130, capacitor 132, and resistor 134 coupled to pins 1, 2, and 3, respectively. Timer programming is set by two switches 152 and 154 that are coupled between pins 12 and 13, respectively, and ground. If the switches are closed, pins 12 and 13 are grounded, otherwise they are pulled up to Vcc through resistors 156 and 158, respectively. In the preferred embodiment, the selectable times are 0.5, 2, 20, and 200 seconds. A mode select pin 10 of the oscillator/timer chip 126 can be programmed to cause the chip to a free-running mode or a one-shot mode. For this purpose, pin 10 is coupled to ground through switch 160 and to Vcc through resistor 162. Pins 5, 7, and 9 of chip 126 are grounded, while pin 14 is connected to Vcc. The output of chip 126 is at pin 8.

The oscillator/timer chip 126 is initiated by pulling pin 6 thereof up to Vcc. Push button 144 is coupled between pin 6 and Vcc, while a pull-down resistor 164 is coupled between pin 6 and ground. Pin 6 is also coupled to the collector of a PNP transistor 166. Transistor 166 has its emitter connected to Vcc and its base coupled to pin 3 of input connector 142 through a resistor 168. The base of transistor 166 is also coupled to ground through capacitor 170 and to Vcc through a pull-up resistor 172. Vcc is supplied to pin 1 of input connector 142 through a diode 174. Normally, pin 3 is pulled to Vcc through resistor 172. When a trigger signal is received on pin 3 from an attached trigger module, pin 3 is grounded, which turns on transistor 166 and supplies Vcc to pin 6 of the oscillator/timer 126. Alternatively, Vcc can be supplied to pin 6 of chip 126 by activating the push button 144. In either case, the programmable oscillator/timer 126 begins timing out and outputs a rising edge voltage on pin 8 when the selected time period has elapsed.

The output at pin 8 of the programmable oscillator/timer 126 turns on LED 150 and triggers the timer chip 72 when it goes positive. Pin 8 of chip 126 is connected to the trigger input pin 4 of timer chip 72, and is coupled through a resistor 176 to the base of a PNP transistor 178. The collector of transistor 178 is coupled through a resistor 180 and the LED 150 to ground.

As described above, the timer chip 72 turns on transistors 82 and 88 for a predetermined period of time (about 2.8 seconds), thus grounding pin 2 of the output connector 140 to output the trigger signal to the action module attached thereto. Thus, the timer trigger module 26 outputs a trigger signal of predetermined duration after a selected time has elapsed after either the button 144 is pushed or pin 2 of input connector 142 is pulled to ground by another trigger module connected thereto.

Preferred specifications for the components of the timer trigger circuit illustrated in FIG. 10 are as follows. Other components are the same as described above.

| | |
|---|---|
| resistor 156 | 10K ohm |
| resistor 162 | 10K ohm |
| transistor 166 | 2N3906 |
| capacitor 170 | 0.1 uf |
| resistor 176 | 4.7K ohm |
| resistor 180 | 240 ohm |
| resistor 158 | 10K ohm |
| resistor 164 | 4.7K ohm |
| resistor 168 | 1K ohm |
| resistor 172 | 10K ohm |
| transistor 178 | 2N3906 |
| resistor 182 | 680 ohm |

Figure 11:
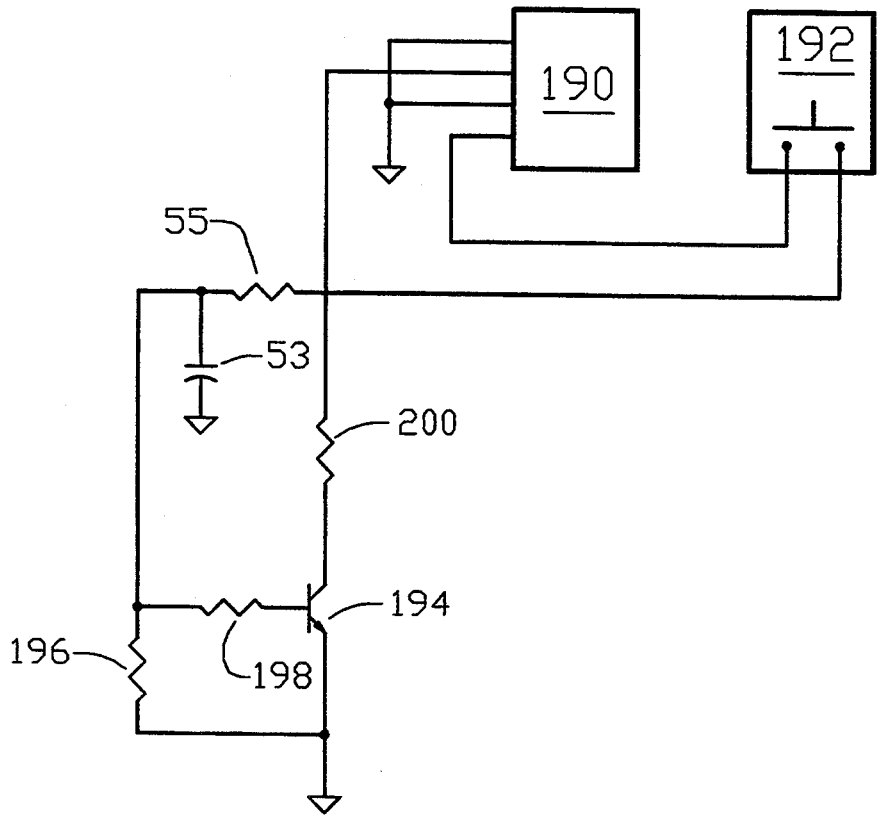
FIG. 11 is a schematic diagram of a push-button trigger module circuit.

FIG. 11 illustrates the circuit of a push button trigger module 24. The circuit includes an output connector 190, a push button switch 192, and an NPN transistor 194 that pulls pin 2 of the connector to ground when the push button is closed. The push button switch 192 is coupled in series between pin 4 of the connector 190 and filter resistor 55 and capacitor 53. A pull-down resistor 196 is coupled between the base of transistor 194 and ground. When the switch 192 is closed, Vcc is supplied through resistor 198 to the base of transistor 194, thus turning it on and grounding pin 2 of connector 190 through resistor 200 to ground. The duration of the trigger signal is controlled by the amount of time the push button switch 192 is closed.

Preferred specifications for the components of the push button trigger circuit illustrated in FIG. 11 are as follows. Other components are the same as described above.

| | |
|---|---|
| transistor 194 | 2N3904 |
| resistor 198 | 1K ohm |
| resistor 196 | 1K ohm |
| resistor 200 | 240 ohm |

Figure 12:
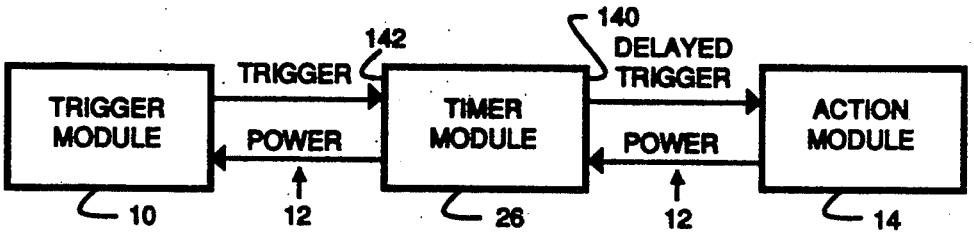
FIG. 12 is a block diagram of a modular device for playing pranks including a timer module disposed between a trigger module and an action module.
Figure 13:
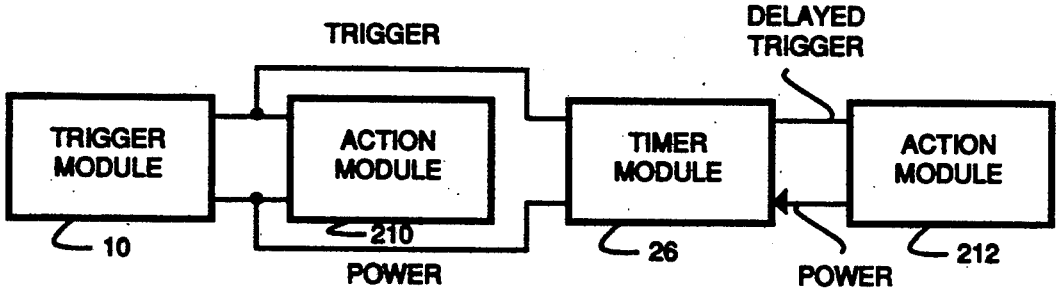
FIG. 13 is a block diagram of a modular device for playing pranks having two action modules, with the second action module being delayed through a timer module.

FIGS. 12 and 13 illustrate the use of a timer module 26. The timer module 26 can be used to delay a trigger signal generated by another trigger module 10. The trigger module 10 that initiates the trigger signal is connected by a cable 12 to input connector 142 of the timer module 26, while an action module 14 is connected by another cable 12 to output connector 140 of the timer module. Power for the timer module 26 and the trigger module 10 is supplied by the action module 14 through the two cables. Whenever the trigger module 10 senses an activating event, it outputs a trigger signal to input connector 142 of the timer module 26. This in turn causes the programmable oscillator/timer 126 of the timer module to delay the trigger signal by some selectable time period. After that time period elapses, the timer module 26 sends a delayed trigger signal to the action module 14.

FIG. 13 shows how a timer module can be used to construct a device that performs two actions separated by some time period. A trigger module 10 is connected by cable to a first action module 210 and also to the input connector 142 of a timer module 26. A second action module 212 is connected by cable to the output connector 140 of the timer module 26. Once the trigger module 10 senses an activating event and generates a trigger signal, the first action module 210 will perform its action. At the same time, the timer module 26 will begin timing and after the programmed delay has elapsed, it will send a delayed trigger signal to the second action module 212, causing the second desired action.

Figure 14:
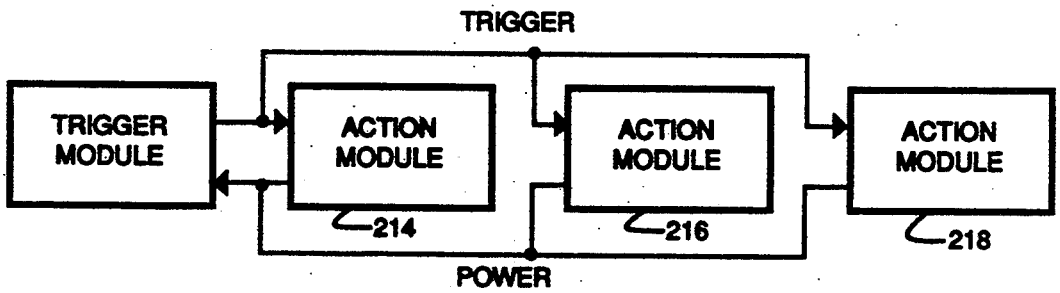
FIG. 14 is a block diagram of a modular novelty device having three action modules.

FIG. 14 illustrates that several action modules 214, 216, and 218 can be actuated by a single trigger module. In the multiple action module configurations shown in FIGS. 13 and 14, the cable interconnections are accomplished by using a multiple outlet RJ11 adapter. A male plug of the adapter is plugged into the connector of one module and multiple female jacks of the adapter receive cables 12 that interconnect to the rest of the modules.

Figure 15:
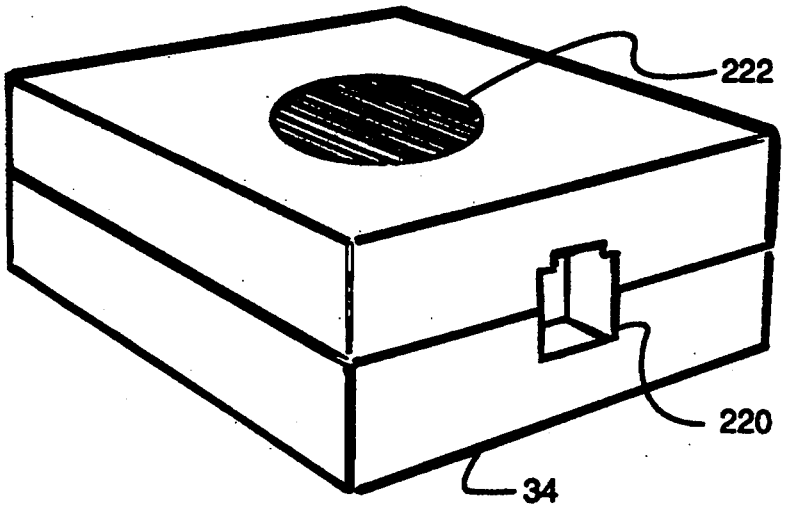
FIG. 15 is a perspective view of a sound-generator action module.
Figure 16:
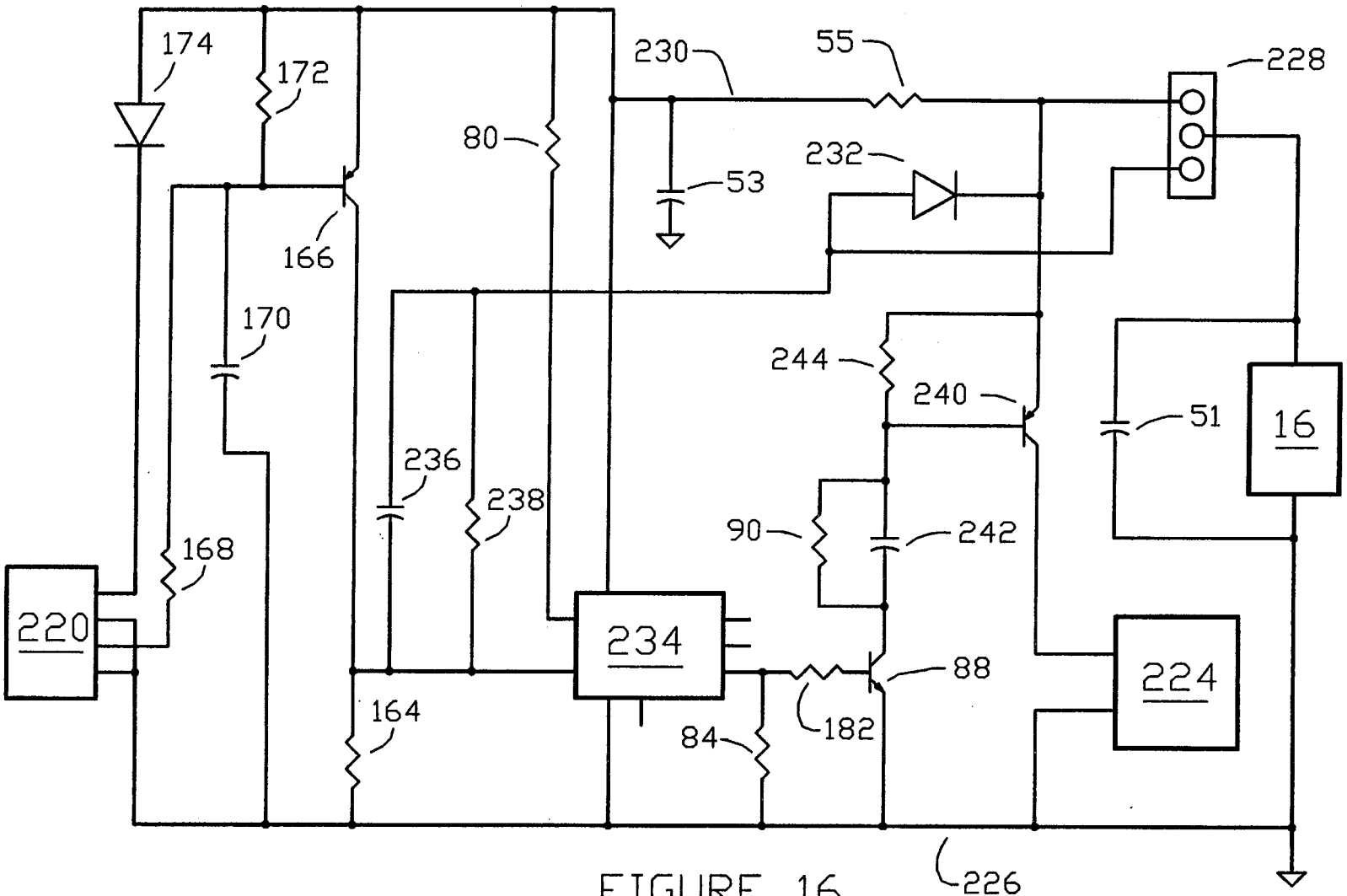
FIG. 16 is a schematic diagram of a sound generating action module circuit.

FIGS. 15 and 16 illustrate a sound-generator action module 34. The sound-generator action module 34 is housed in a housing that is separate from any trigger module 10. The housing includes an RJ11-type connector 220 that is connected to the circuitry of the sound generator, and includes a grill 222 behind which is positioned a speaker 224 that produces the sound.

As shown in FIG. 16, the circuitry of the sound-generator action module 34 is powered by a battery 16 that has its negative terminal connected to a ground rail 226 and its positive terminal connected to a switch 228. Vcc from the battery is supplied through the switch 228 to a Vcc rail 230 to the circuitry of the sound-generator module and to pin 1 of connector 220 when the switch is set to either "on" or "test". When the switch 228 is switched to "test" Vcc from the battery is supplied to the Vcc rail 230 through a diode 232. The ground rail 226 is connected to pins 2 and 4 of the connector 220. Power is filtered by capacitors 51 and 53 and resistor 55 as described above. Pin 1 of connector 220 is isolated from the Vcc rail 230 by diode 174 so that interconnected action modules, such as shown in FIG. 14, have electrically isolated power supplies.

A sound chip 234 is utilized to generate sounds when triggered by a trigger signal received at pin 3 of connector 220. The sound chip 234 is preferably a model MSS0151 or MSS0283 speech synthesizer (voice ROM) from Mosel Corporation, just like the timer chip 72 described above. The sound chip 234 is activated by a rising edge signal applied to pin 4. When a trigger signal is received on pin 3 of connector 220, signified by ground potential, transistor 166 turns on and inputs a rising edge to the trigger input of the sound chip 234. Alternatively, when the selector switch 228 is set to "test" position, a rising edge pulse is supplied to the trigger input of the sound chip 234 through capacitor 236 and resistor 238.

Once the sound chip 234 is triggered, it outputs a current on pin 5 thereof that corresponds to a sound that has been stored in the ROM of the sound chip. The sound chip output drives transistor 88, which in turn drives PNP transistor 240 through resistor 90 and capacitor 242. Transistor 240 in turn drives the speaker 224 to produce the audible sound. A resistor 244 is coupled between the emitter and base of transistor 240 to pull the base up to Vcc when transistor 88 turns off.

The wiring of the connector 220 (and connectors for other action modules, too) assumes that the cable 12 interconnecting an action module 14 to a trigger module 10 is configured like a standard telephone cable. In other words, pins 1, 2, 3, and 4 of the RJ11 plug at one end are connected to pins 4, 3, 2, and 1, respectively, of the RJ11 plug at the other end of the cable.

Preferred specifications for the components of the sound generator circuit illustrated in FIG. 16 are as follows. Other components are the same as described above.

| | |
|---|---|
| capacitor 236 | 22 uf |
| transistor 240 | TIP 32 |
| resistor 244 | 1K ohm |
| resistor 238 | 4.7K ohm |
| capacitor 242 | 22 uf |

Figure 17:
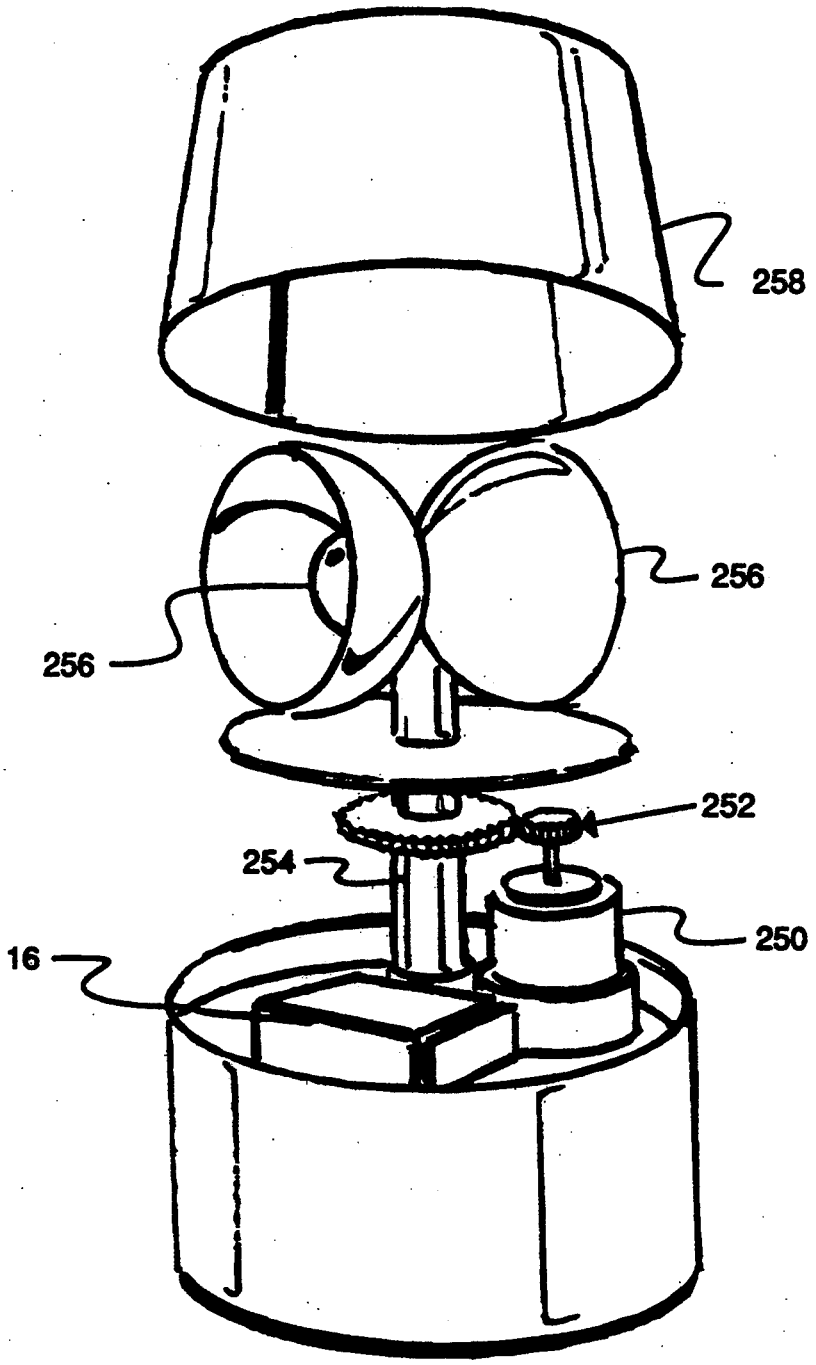
FIG. 17 is an exploded, perspective view of a motor-driver action module that includes a rotating light.
Figure 18A:
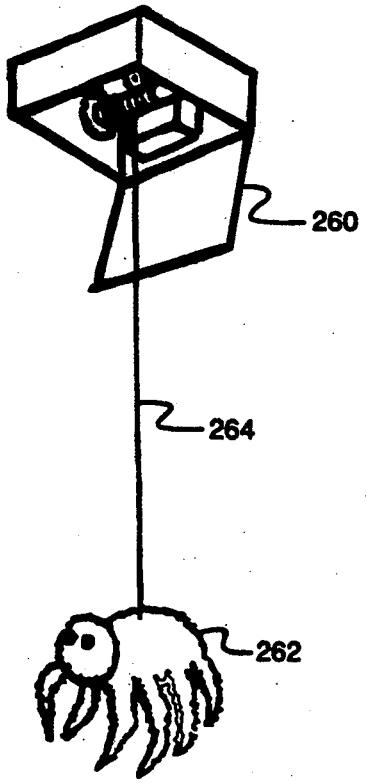
FIGS. 18*a* and 18*b* are perspective views of a motor-driver action module that includes a winch and suspended cable.
Figure 18B:
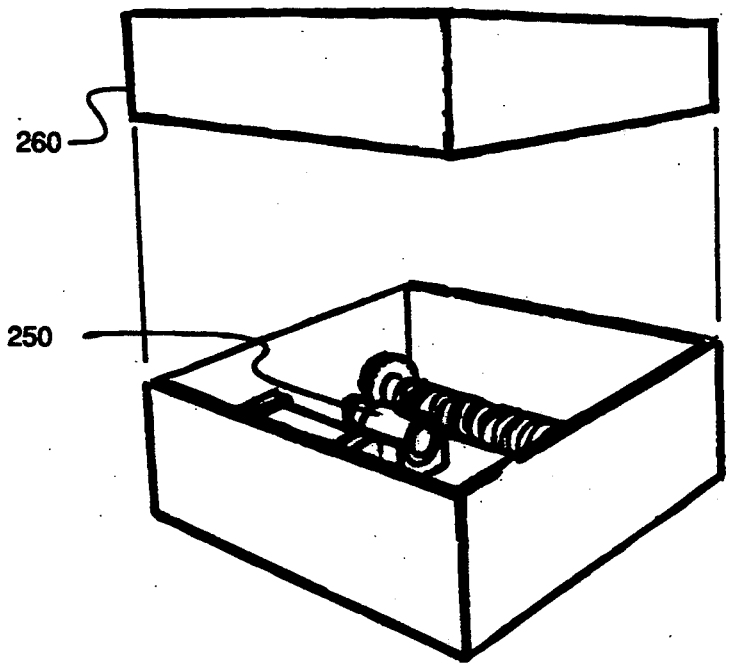
Figure 19:
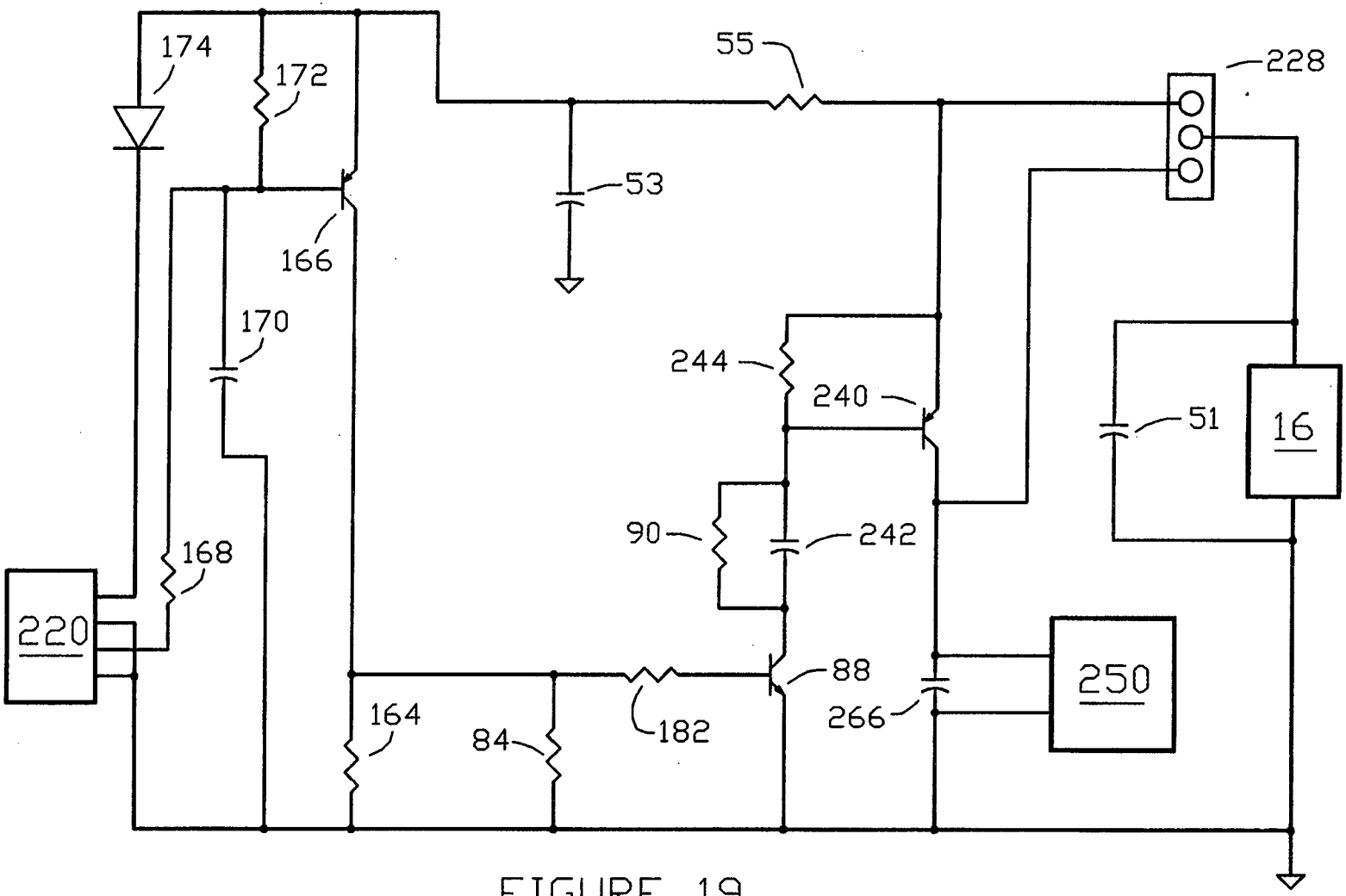
FIG. 19 is a schematic diagram of a motor-driver action module circuit.

FIGS. 17, 18, and 19 illustrate various aspects of motor-driver action modules 36. The basic action of a motor-driver action module 36 is to power a rotary motor for the duration of the trigger signal, thereby causing some sort of amusing action or prank. In FIG. 17 for example, the prank is flashing and rotating strobe lights. When this action module is operating, the motor 250 drives a set of gears 252 that turns a shaft 254 to rotate two strobe lights 256. With a transparent cover 258 removed, FIG. 17 shows that a battery pack 16 is accessible. The remaining circuitry of the motor-driver is packaged under the motor and battery.

FIG. 18 illustrates a motor-driver action module 36 that includes a winch and suspended cable. When this action module is triggered, the motor 250 activates a mechanism that releases a trap door 260 and lowers and dangles a fake spider 262 on a string 264.

FIG. 19 is a schematic diagram of the circuit used in the motor-driver action module 36. The power connections and trigger signal processing components are the same as described above with respect to FIG. 16, except a sound chip 234 is not required. When a trigger signal is received from pin 3 of connector 220, transistor 166 turns on and supplies Vcc to the base of transistor 88, which turns on and grounds the base of transistor 240 to turn it on. The output of transistor 240 drives the motor 250 for the duration of the trigger signal. A 0.1 uf capacitor 266 is coupled across the leads of the motor 250. The selector switch 228 can be used to test the operation of the motor by moving the switch to the "test" position, which supplies Vcc to the motor until the switch is reset.

Figure 20:
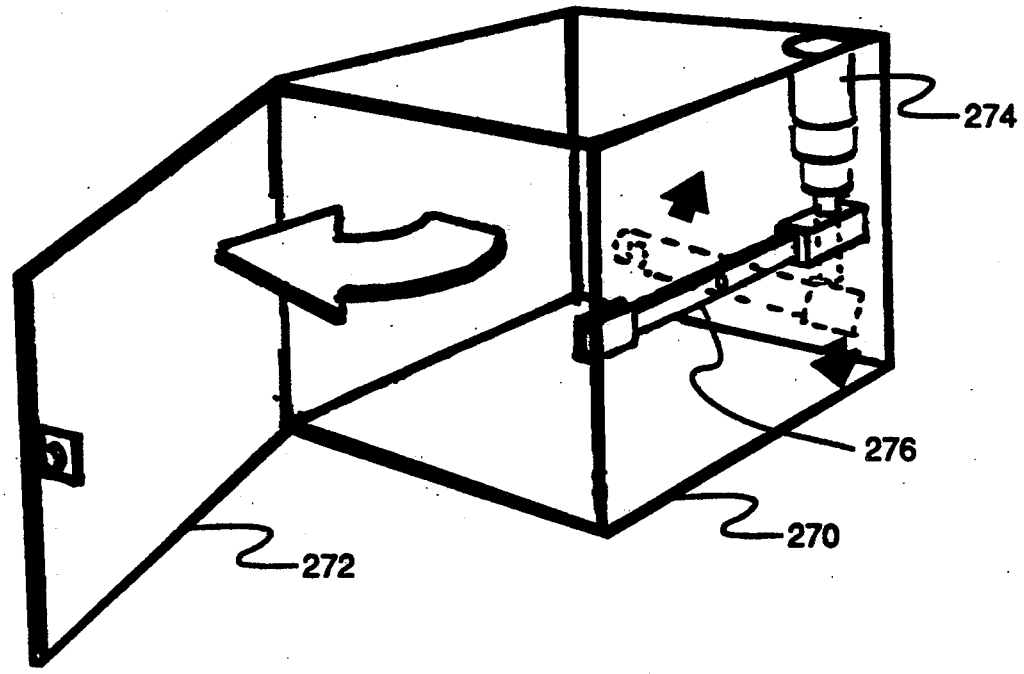
FIG. 20 is a perspective view of a solenoid-driver action module that includes a door-opening mechanism.
Figure 21A:
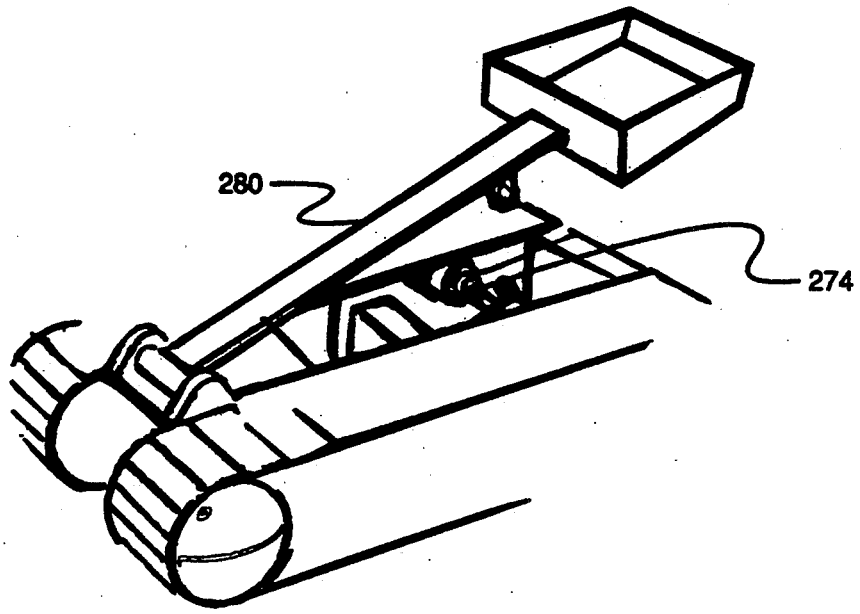
FIG. 21*a* is a perspective view of a solenoid-driver action module that includes a catapult.
Figure 21B:
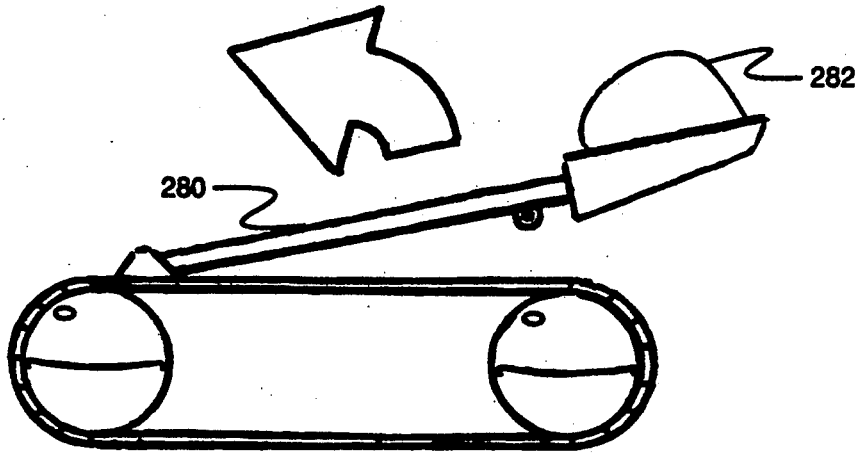
Figure 21C:
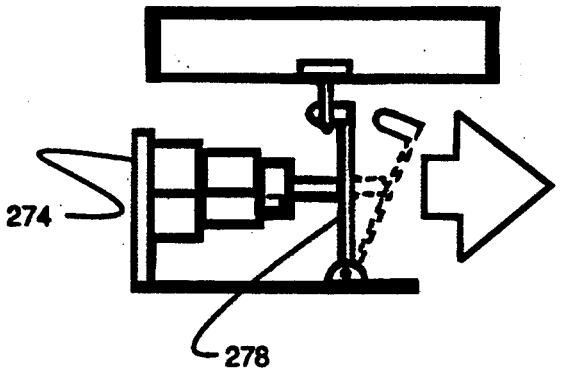
FIG. 21*c* is a sectional view of the catapult illustrating a solenoid release mechanism.
Figure 22:
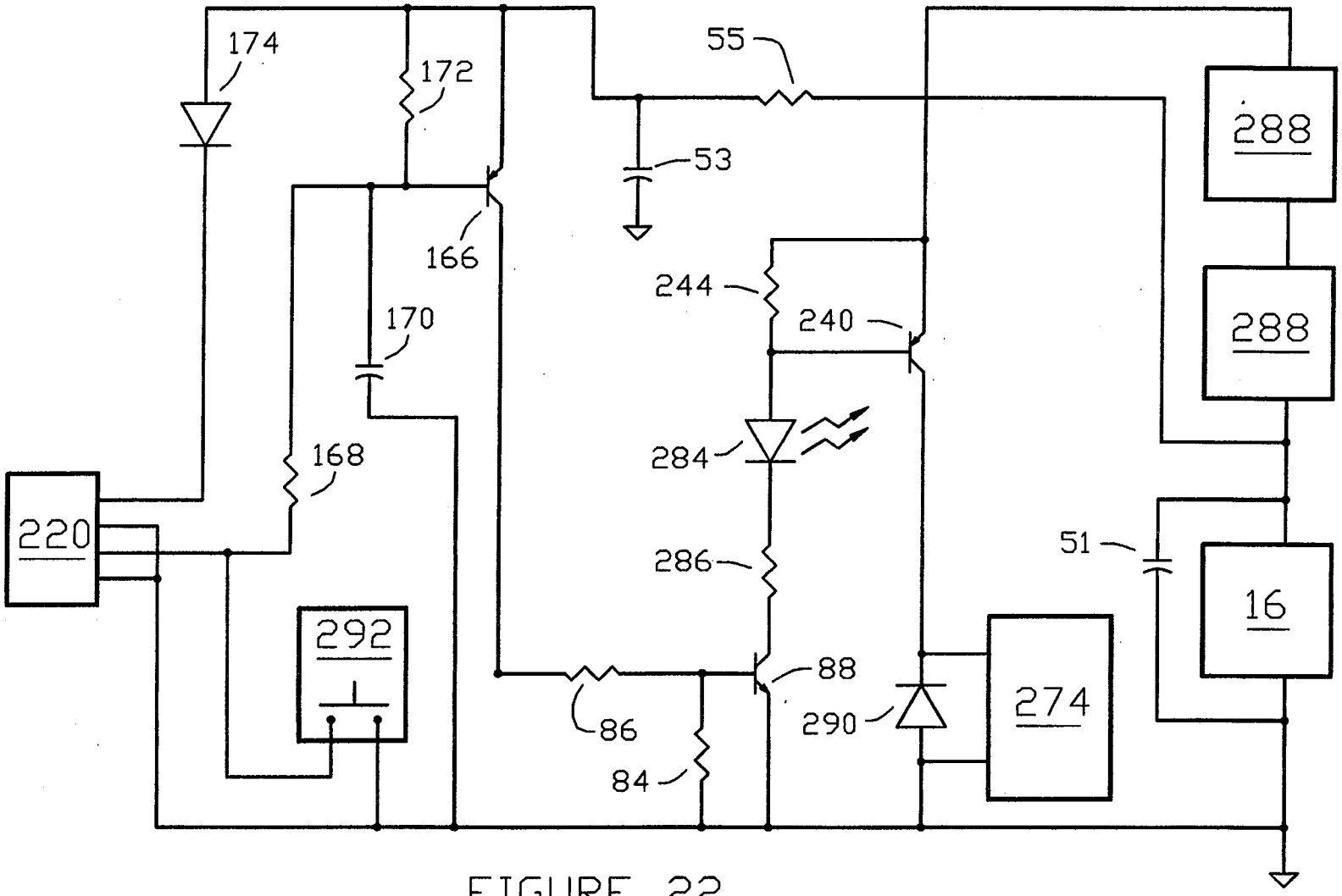
FIG. 22 is a schematic diagram of a solenoid-driver module circuit.

FIGS. 20, 21, and 22 illustrate various aspects of solenoid-driver action modules 38. The basic action of a solenoid-driver action module 38 is to power a solenoid for the duration of the trigger signal, thereby causing an amusing action or prank. In FIG. 20 for example, the action module 270 is a box containing a coiled up snake or jack-in-the-box (not shown) that leaps out of the box when the door 272 is opened. A solenoid 274 controlled by the solenoid-driver circuit pushes on one end of a lever 276 that unlatches the door 272 when the solenoid is activated.

FIG. 21 illustrates a solenoid-driver action module 38 that takes the form of a catapult. FIG. 21*c* shows a solenoid 274 that releases a lever 278 when the solenoid is activated, thereby allowing the catapult 280 to spring forward. An object like a water balloon 282 can be thrown with this device upon receiving a trigger signal from a trigger module.

FIG. 22 illustrates the circuitry of the solenoid-driver action module 38. This circuit has several components that are the same as the circuit of the motor-driver module (FIG. 19). When a trigger signal is received at pin 3 of connector 220, transistor 166 turns on transistor 88, which in turn turns on transistor 240. When transistor 88 is on, it illuminates an LED 284 that is coupled between the base of transistor 240 and the collector of transistor 88 with a resistor 286 in series. The preferred solenoid needs more that the approximately 6 volts obtained from battery 16, so two additional batteries 288 are added to boost the voltage applied to the solenoid 274 to about 18 volts. A diode 290 is coupled across the leads of the solenoid. For testing the circuit without a trigger module, a push button 292 is provided to turn on the transistors and energize the solenoid.

Preferred specifications for the components of the solenoid-driver circuit illustrated in FIG. 22 are 120 ohm for resistor 286 and type 1N914 for diode 290. Other components are the same as described above. The solenoid shown operates off of 18 volts, but a 6 volt solenoid could be substituted, with the advantage that the boost circuitry could be eliminated.

From the above description, it will be apparent that the invention disclosed herein provides a novel and advantageous remote-controlled amusement device and method of use. The foregoing discussion discloses and describes merely exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

What is claimed is:

1. A remotely actuated amusement system for playing pranks comprising:

at least two trigger modules each including means for detecting the occurrence of a different activating event and means for generating a common trigger signal in response thereto;

at least two action modules each housed apart from the trigger modules and including means for performing a prank in response to the trigger signal, each action module further including a battery for providing power to the action module means and to a cable, wherein different action modules include means for performing different pranks; and a cable electrically interconnecting a selected one of the trigger modules and a selected one of the action modules.

2. A remotely actuated amusement system as recited in claim 1 wherein one of the trigger modules is a timer that includes means for generating the trigger signal a predetermined time after being activated.

3. A remotely actuated amusement system as recited in claim 1 wherein one of the activating events is the generation of an ultrasonic sound, and wherein one of the trigger modules includes means responsive to the ultrasonic sound for generating the trigger signal.

4. A remotely actuated amusement system as recited in claim 3 further comprising an ultrasonic whistle means for generating the ultrasonic sound by blowing air therethrough.

5. A remotely actuated amusement system as recited in claim 3 further comprising an ultrasonic transducer and means for exciting the ultrasonic transducer at an ultrasonic frequency to generate the ultrasonic sound.

6. A remotely actuated amusement system as recited in claim 1 wherein one of the activating events is the generation of an infrared emission, and wherein one of the trigger modules includes detector means responsive to the infrared emission for generating the trigger signal.

7. A remotely actuated amusement system as recited in claim 1 wherein one of the activating events is the detection of an object in the proximity of one of the trigger modules which includes detector means responsive to the proximity of the object for generating the trigger signal.

8. A remotely actuated amusement system as recited in claim 7 wherein said one of the trigger modules further includes an infrared emitter and an infrared detector both housed in the trigger module and forming a proximity detector including means responsive to infrared emissions being reflected by an object in close proximity thereto for generating the trigger signal.

9. A remotely actuated amusement system as recited in claim 1 wherein one of the action modules comprises a sound producing unit that produces a sound in response to the trigger signal, the sound producing unit including a receiver circuit that detects the trigger signal and a sound generator circuit that generates a predetermined sound in response to the detection of the trigger signal.

10. A remotely actuated amusement system as recited in claim 1 wherein one of the action modules comprises a motor-driver unit that drives a motor in response to the trigger signal, the motor-driver unit including a receiver circuit that detects the trigger signal and a motor-driver circuit that drives a motor for a predetermined time in response to the detection of the trigger signal.

11. A remotely actuated amusement system as recited in claim 1 wherein one of the action modules comprises a solenoid-driver unit that drives a solenoid in response to the trigger signal, the solenoid-driver unit including a receiver circuit that detects the trigger signal and a solenoid-driver circuit that activates a solenoid in response to the detection of the trigger signal.

12. A remotely actuated amusement system as recited in claim 1 wherein the cable comprises a four conductor cable with an RJ11-type plug connector on an end thereof for releasably coupling the cable to an associated module, and wherein the associated module includes an RJ11-type jack connector for releasably coupling to the connector of the cable.

13. A remotely actuated amusement system as recited in claim 1 wherein the cable further comprises means for interconnecting a trigger module to at least two action modules by supplying the trigger signal from the trigger module to all the action modules.

14. A method of constructing and using a remotely actuated amusement device for playing pranks, the method comprising the steps of:

selecting a trigger module from a group of at least two different trigger modules, wherein each trigger module includes means for detecting the occurrence of an activating event and means for generating a trigger signal in response thereto, and wherein different trigger modules include means for detecting the occurrence of different activating events;

selecting an action module from a group of at least two different action modules, wherein each action module includes action means for performing a prank in response to the trigger signal and further includes a battery for providing power to the action means and to a cable, and wherein different action modules include means for performing different pranks;

electrically interconnecting the selected trigger module and the selected action module; and then playing the prank by performing the activating event.

15. A remotely actuated amusement device for playing pranks comprising:

a trigger module including means for detecting the occurrence of an activating event and means for generating a trigger signal of finite duration in response thereto;

an action module housed apart from the trigger module and including action means for performing a prank in response to the trigger signal, and further including a battery coupled to the action means and to a cable;

a timer interconnected between the trigger module and the action module and including means for delaying the transmission of the trigger signal from the trigger module to the action module by a predetermined time; and a cable electrically interconnecting the trigger module, the action module, and the timer.

16. A remotely actuated amusement device for playing pranks comprising:

an infrared emitting device including means for generating an infrared emission;

a trigger module housed apart from the infrared emitting device and including means for detecting the infrared emission, wherein the trigger module includes detector means responsive to the infrared emission for generating a trigger signal of finite duration in response thereto;

an action module housed apart from the trigger module and the infrared emitting device and including action means for performing a prank in response to the trigger signal, and further including a battery coupled to the action means and to a cable;

a cable electrically interconnecting the trigger module and the action module.

* * * * *